US006079662A

United States Patent [19]

Miller et al.

[11] Patent Number: 6,079,662

[45] Date of Patent: Jun. 27, 2000

[54] SLIP SHAFT ASSEMBLY HAVING CORE AXIAL POSITION FIXING MECHANISM

[75] Inventors: William C. Miller, Portland; Semion Stolyar, Beaverton, both of Oreg.

[73] Assignee: Tidland Corporation, Camas, Wash.

[21] Appl. No.: 09/283,822

[22] Filed: Mar. 31, 1999

[51] Int. Cl.[7] ..... B65H 75/24

[52] U.S. Cl. ..... 242/571.2; 242/530.3; 242/576.1; 242/578

[58] Field of Search ..... 242/576.1, 571.2, 242/594.3, 578, 578.2, 530.3

[56] References Cited

U.S. PATENT DOCUMENTS

| | | | |
|---|---|---|---|
| 1,803,193 | 4/1931 | Kennedy . | |
| 1,929,160 | 10/1933 | Bellocchio . | |
| 2,062,421 | 12/1936 | Lindbom . | |
| 2,289,453 | 7/1942 | Randall . | |
| 2,331,743 | 10/1943 | Sullivan . | |
| 2,537,492 | 1/1951 | Tidland . | |
| 2,733,022 | 1/1956 | Grody . | |
| 2,749,133 | 6/1956 | Rich | 279/2 |
| 2,801,694 | 8/1957 | Schneider et al. | 164/70 |
| 2,849,192 | 8/1958 | Fairchild . | |
| 2,869,329 | 1/1959 | Jourdain . | |
| 3,188,017 | 6/1965 | Orton, Sr. . | |
| 3,197,153 | 7/1965 | Davidson . | |
| 3,214,109 | 10/1965 | Gadde et al. . | |
| 3,298,626 | 1/1967 | Frick et al. . | |
| 3,391,876 | 7/1968 | Dalglish . | |
| 3,552,672 | 1/1971 | Grettve et al. . | |
| 3,554,457 | 1/1971 | Hutzenlaub et al. . | |
| 3,592,405 | 7/1971 | Young . | |
| 3,592,408 | 7/1971 | Eickhoff | 242/130 |
| 3,596,847 | 8/1971 | Peterson . | |
| 3,628,745 | 12/1971 | Taeffner et al. . | |
| 3,703,996 | 11/1972 | Ulseth . | |
| 3,799,465 | 3/1974 | Erny . | |
| 3,817,468 | 6/1974 | Smolderen et al. | 242/530.3 |
| 3,847,366 | 11/1974 | Schmidt et al. . | |
| 3,904,143 | 9/1975 | Kullander . | |
| 3,904,144 | 9/1975 | Gattrugeri . | |
| 3,907,229 | 9/1975 | Iannucci et al. | 242/129.8 |
| 3,917,187 | 11/1975 | Damour . | |
| 3,937,412 | 2/1976 | Damour . | |
| 3,941,328 | 3/1976 | Johnson . | |
| 4,026,491 | 5/1977 | Bostroem | 242/430.3 |
| 4,050,643 | 9/1977 | Secor . | |
| 4,114,756 | 9/1978 | Dacey et al. | 206/389 |
| 4,114,909 | 9/1978 | Taitel et al. | 279/1 |
| 4,124,173 | 11/1978 | Damour . | |
| 4,147,312 | 4/1979 | Secor et al. | 242/76.1 |
| 4,200,301 | 4/1980 | Ryan | 279/2 |
| 4,254,920 | 3/1981 | Peterson . | |
| 4,266,737 | 5/1981 | Mastriani . | |

(List continued on next page.)

*Primary Examiner*—Katherine A. Matecki
*Attorney, Agent, or Firm*—Chernoff, Vilhauer, McClung & Stenzel

[57] ABSTRACT

An expansible core shaft assembly adapted to retain a set of web spool cores in axially fixed positions while permitting rotational slippage of the web spool cores. The assembly may comprise a shaft defining at least one channel. An expansible bladder is retained in the channel and a set of first lugs and a set of second lugs are retained in the channel radially outwardly of the expansible bladder with first and second lugs mutually interspersed. Each lug has a bladder facing surface defining an indentation. The first lugs define a first indentation in a first position and the second lugs define a second indentation that is sufficiently distinct from said first position to reduce the effect that the radial position of each core stop has on the radial positions of its neighbors. In a separate embodiment the assembly may comprise a channel accommodating a first expansible bladder and a bracket positioned radially outwardly from the first bladder and defining a second channel, which accommodates a second bladder. Core stops are set into the second channel radially outwardly of the second bladder. The first and second bladders are independently expansible so that the core stops may be released for rearrangement independently of being retracted.

15 Claims, 9 Drawing Sheets

U.S. PATENT DOCUMENTS

| | | | |
|---|---|---|---|
| 4,433,814 | 2/1984 | Pontes et al. . | |
| 4,461,430 | 7/1984 | Lever . | |
| 4,469,288 | 9/1984 | Pontes . | |
| 4,492,346 | 1/1985 | Young . | |
| 4,534,519 | 8/1985 | Euteneuer et al. . | |
| 4,593,864 | 6/1986 | Stromme . | |
| 4,771,963 | 9/1988 | Gattrugeri . | |
| 4,828,198 | 5/1989 | Kann et al. . | |
| 4,840,323 | 6/1989 | Nakajima . | |
| 4,964,586 | 10/1990 | Lerch . | |
| 4,991,791 | 2/1991 | Cocito | 242/110 |
| 5,156,352 | 10/1992 | Ziessmer . | |
| 5,279,470 | 1/1994 | Birkmann et al. . | |
| 5,292,084 | 3/1994 | Lofstrom . | |
| 5,372,331 | 12/1994 | Miller et al. | 242/571 |
| 5,379,964 | 1/1995 | Pretto et al. | 242/571.2 |
| 5,451,010 | 9/1995 | Heuser | 242/530.3 |
| 5,465,919 | 11/1995 | Kikuchi | 242/532.6 |
| 5,509,618 | 4/1996 | Kleiman et al. | 242/571.2 |
| 5,597,134 | 1/1997 | Marin | 242/571.2 |
| 5,690,300 | 11/1997 | Iannucci | 242/571.2 |
| 5,746,386 | 5/1998 | Marin | 242/571.2 |
| 5,746,387 | 5/1998 | Pretto et al. | 242/571.2 |
| 5,775,631 | 7/1998 | Murakami | 242/573.9 |

SLIP SHAFT ASSEMBLY HAVING CORE AXIAL POSITION FIXING MECHANISM

BACKGROUND OF THE INVENTION

The present invention has to do, in part, with a slip shaft having either an automatic or a conveniently adjustable mechanism for preventing axial migration of web spool cores. In a web converting facility it is frequently necessary to divide or slit a parent roll of web material into a series of smaller rolls of various widths. To do this the parent roll is unwound through a slitter machine and then rewound onto a set of web spool cores to form a set of uptake rolls, all of which are mounted on uptake shafts. The uptake rolls may have varying diameters because of treatment of the web material that takes place in the same operation as the slitting, increasing the web thickness. The varying uptake roll diameters create a need for different uptake roll rotational speeds in order for the web material linear speed to be the same for the web material traveling to each uptake roll. A slip shaft is typically used to accommodate this requirement when two or more uptake rolls are mounted on the same shaft. This is a shaft that permits the uptake web spool cores to slip (i.e. rotate a different speed) relative to the shaft. Various mechanisms may be used to maintain a steady web tension, but these are not part of the subject matter of this patent.

Unfortunately, cores that slip rotationally relative to a shaft, also have a tendency to slip axially along the shaft. A number of strategies have evolved to address the problem of axial migration of web spool cores on a slip shaft.

A first existing method for stopping the axial migration of cores is to equip the slip shaft with an axially aligned set of closely spaced core stops that are all urged outwardly by a long bladder that is pressurized after the cores have been placed on the shaft. Where a web spool core is present, the core stops are restrained from outward movement and provide pressure to the core interior to maintain the web in tension. Where the cores are not present, the core stops protrude, theoretically restraining the cores from axial migration.

A problem with this first existing method is caused by the fact that a first core stop that is restrained by a core will, in turn, restrain the bladder. Therefore, a neighboring second core stop will not be pushed outwardly very far, because the bladder is restrained by the first core stop in its vicinity. As a result, the desired sharp restraining border at each axial end of each web spool core is not formed and cores do, in fact, migrate.

A second existing method for stopping the axial migration of cores is to equip the slip shaft with a set of restraining core stops that are set into a bracket, an axial channel having a pneumatic bladder for pushing the bracket and core stops outwardly and temporarily fixed in place by set screws. This method is taught by Marin in U.S. Pat. Nos. 5,597,134 and 5,746,386. Although this stops the axial slipping, the requirement of manually unfastening the set screws, adjusting the core stops and then refastening the set screws is onerous, especially when, as is typical, the shaft is in a difficult to access location or requires an adjustment after the spooling process has started.

An additional method for stopping axial migration is by placing empty cores in between the roll cores. This method is a little difficult to adjust, and causes a good deal of rubbing at the edges of the cores, which is generally detrimental to the process.

Yet another known method for stopping the axial migration of cores is to equip a core shaft with two channels, each of which houses a pneumatic bladder and a set of core stops positioned radially outwardly of the bladder. When the bladder is inflated the core stops are held in position, preventing axial migration. When the bladder is deflated the core stops may be moved to new positions, to accommodate a different arrangement of cores. Unfortunately, this system has the weakness that the bladder must be deflated to permit a particular set of web spool cores to be removed. When the bladder is in this deflated state, there is nothing to prevent the core stops from moving, especially if contacted by the cores that are being removed, as is typically the case. Afterwards, even if the exact same previous arrangement of core stops is desired, the core stops must be repositioned to the positions that they had prior to the bladder deflation. In paper mills and other operations using slip shafts, it is typical to retain a set of core positions for at least a few of operations with successive sets of cores. In fact, sometimes the same core stop positions may maintained for weeks or months. With the method described in this paragraph, the mill personnel must repetitively perform the task of resetting the core stops, which would be unnecessary if there was some way to retain the core stop positioning between sets of cores.

Another problem encountered in the use of core stops is the tendency of web spool cores to "ride up" onto core stops, press downwardly upon them and flatten and "rode over" the core stops. When this happens, the core stops are unable to prevent the axial migration of web spool cores. With the stop inside the core, unwanted friction is placed on the core interior disrupting the slipping process.

Web core retaining shaft assemblies in general typically have tension segments that are pressed outwardly by an air bladder to maintain tension on the interior surfaces of the cores. Sometimes these segments protrude slightly even when the air bladder is not inflated, because, for example, a first segment could ride up and/or "catch" on neighboring second and/or third segments. When this happens, it may become quite difficult to remove one or more of the web spool cores from the shaft. If the web spool cores are removed automatically, the automatic removal mechanism could damage the cores and itself. In grip shafts another tension segment problem is encountered in the use of tension segments in helical air bladder accommodating channels such as those described in U.S. Pat. No. 5,445,342. Because existing tension segment designs cannot fit into these helical channels unless the tension segments are slightly pliable, elastomeric tension segments are currently used for this application. Unfortunately, elastomeric materials wear away faster than does steel. It would be beneficial if there was some way of using steel tension segments in a helical channel.

BRIEF SUMMARY OF THE INVENTION

In a first preferred aspect, the present invention is a slip shaft assembly adapted to retain a set of web spool cores in axially fixed positions. The assembly comprises a shaft defining a first channel. A first expansible bladder is set into the first channel and a bracket that is set into the first channel radially outwardly of the first pneumatic bladder defines a second channel. A second expansible bladder is set into the second channel and a set of core stops are set into the second channel radially outwardly of the second expansible bladder. The first and the second bladders are separately controllably expansible and shrinkable so that the positions of the core stops may be retained while web spool cores are being replaced.

In a second preferred aspect, the present invention is a slip shaft assembly adapted to retain a set of web spool cores in axially fixed positions. The assembly comprises a shaft defining a channel having a first longitudinal side and a second longitudinal side. A bladder is set into the channel and a core stop is set into the channel over the bladder. The core stop is operatively hinged to the first longitudinal side of the channel so that when the bladder is inflated the core stop rotates about the hinge as it is pushed radially outwardly by the bladder in a first rotational direction.

In a third preferred aspect, the present invention is an slip shaft assembly adapted to retain a set of web spool cores in axially fixed positions while permitting rotational slippage of the web spool cores. The assembly comprises a shaft defining a channel extending substantially axially along the core shaft; an expansible bladder retained in the channel; and a set of first lugs and a set of second lugs retained in the channel radially outwardly of the expansible bladder and mutually interspersed. Each of the lugs has a bladder facing surface. Furthermore, the first lugs define an indentation in the bladder facing surface in a first position, and the second lugs as oriented in said channel define an indentation in a second position that is distinct from said first position.

In a fourth preferred aspect, the present invention is a slip shaft assembly adapted to retain a set of web spool cores in axially fixed positions. The assembly comprises a shaft defining a channel and a fluid expansible bladder set into the channel. In addition a set of rings is positioned about the shaft. Each ring has an inward projection fitted into the channel, whereby when the expansible bladder is in its expanded state each ring is retained in axial position.

In a fifth preferred aspect, the present invention is a slip shaft assembly adapted to retain a set of web spool cores. The assembly comprises a shaft defining a channel and a fluid expansible bladder set into the channel. A set of lugs is positioned in the channel radially over the fluid expansible bladder, each lug having a first lug contacting side and a second lug contacting side. Furthermore, the first lug contacting side of a first lug mates with the second lug contacting side of an adjacent lug in such a manner that the first side of the first lug and the second side of the adjacent lug are substantially linked in radial position.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
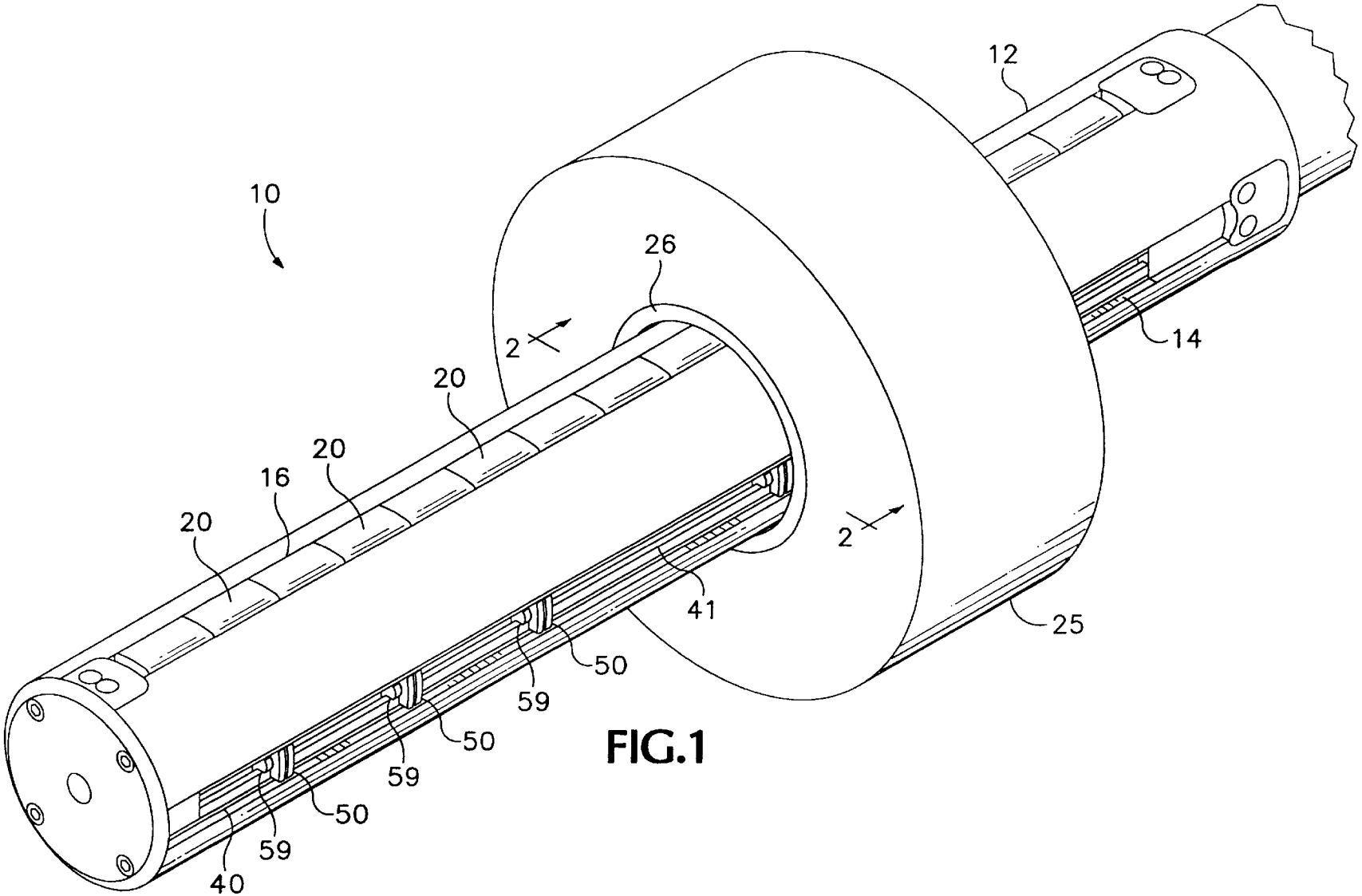
FIG. 1 is a perspective view of a preferred embodiment of a slip shaft assembly according to the present invention.

Referring to FIGS. 1–5, a preferred embodiment of the present invention is a slip shaft assembly 10, including a shaft 12 that defines two core stop channels 14*a* and 14*b* and two pressure lug channels 16. Each channel 14*a*, 14*b* and 16 is equipped with a web spool core retention pneumatic (expansible) bladder 18. Bladders 18 are plumbed in common so that they are controllably inflated (expanded) and deflated (shrunk) simultaneously. The pressure lug channels 16 each accommodate a set of pressure lugs 20 positioned radially outwardly of a bladder 18 for applying pressure to the interior walls of the web spool cores, such as a core 26 of a web spool 25, during shaft 12 rotation. This pressure keeps the cores turning at a sufficient speed to keep the web taut.

Figure 3:
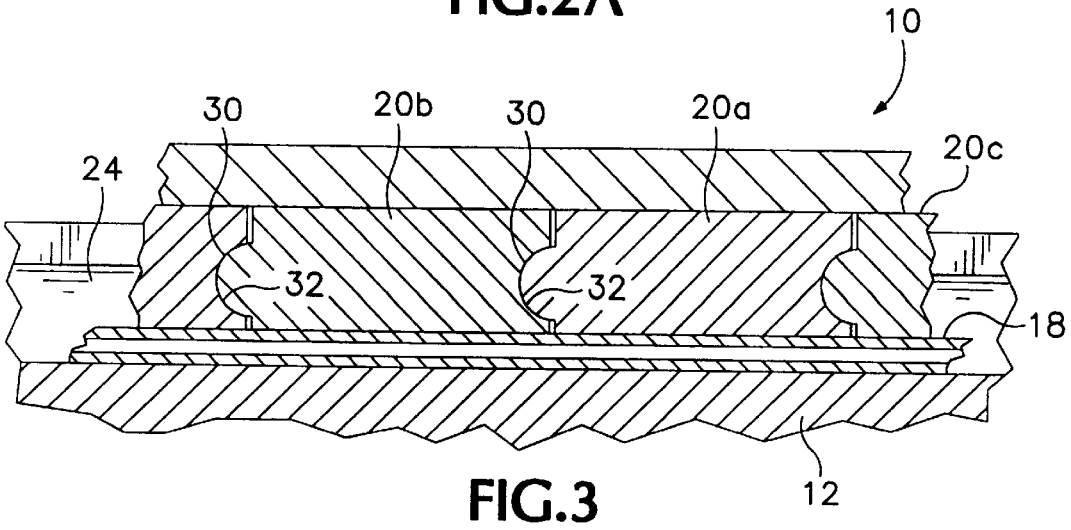
FIG. 3 is a cross-sectional view of the shaft assembly of FIG. 1 taken along line 3—3 of FIG. 2A.
Figures 4, 5:
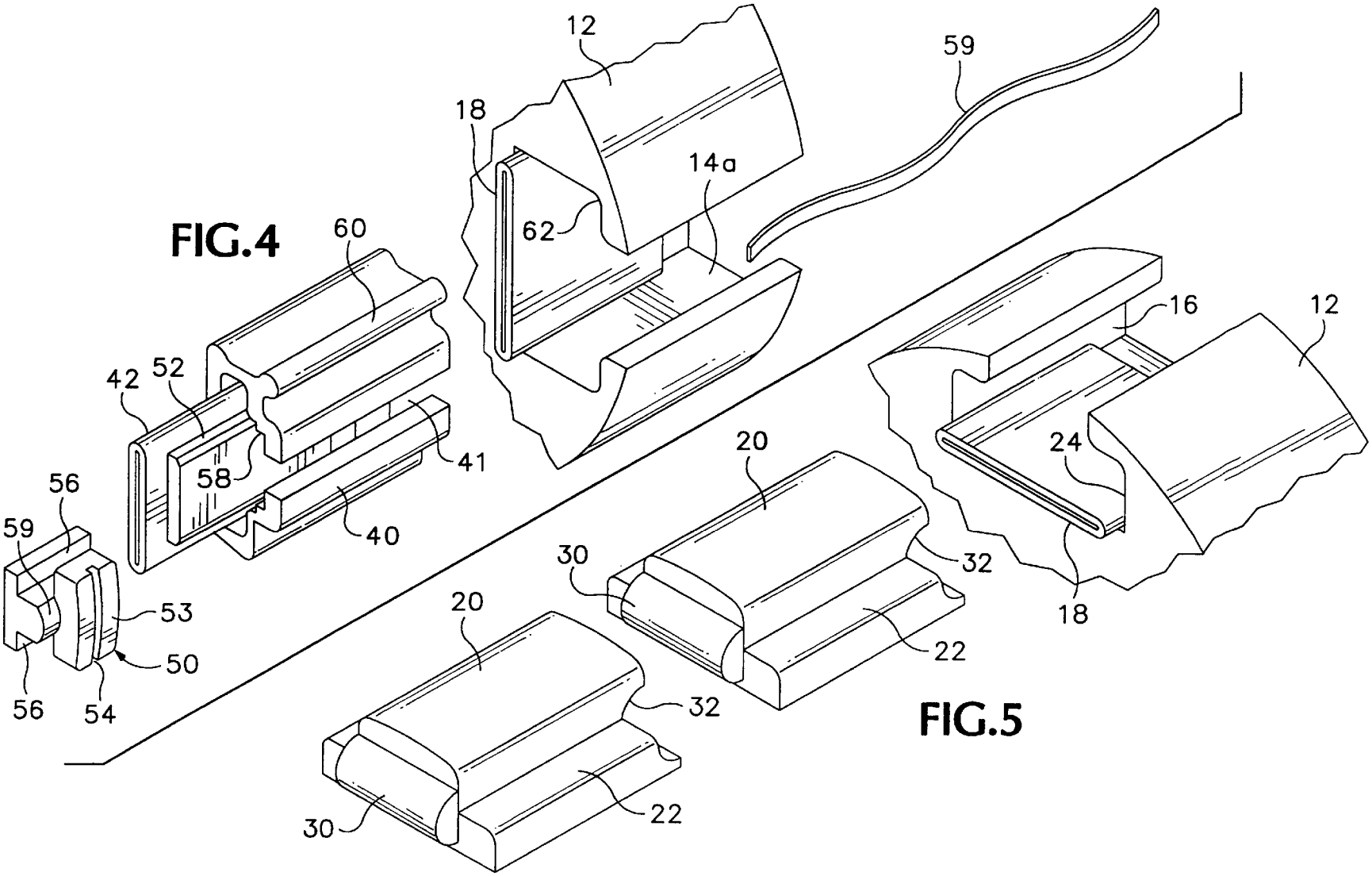
FIG. 4 is an exploded view the contents of a core stop channel of the shaft assembly of FIG. 1.
FIG. 5 is an expanded view of the contents of a pressure lug channel of the shaft assembly of FIG. 1.
Figure 6:
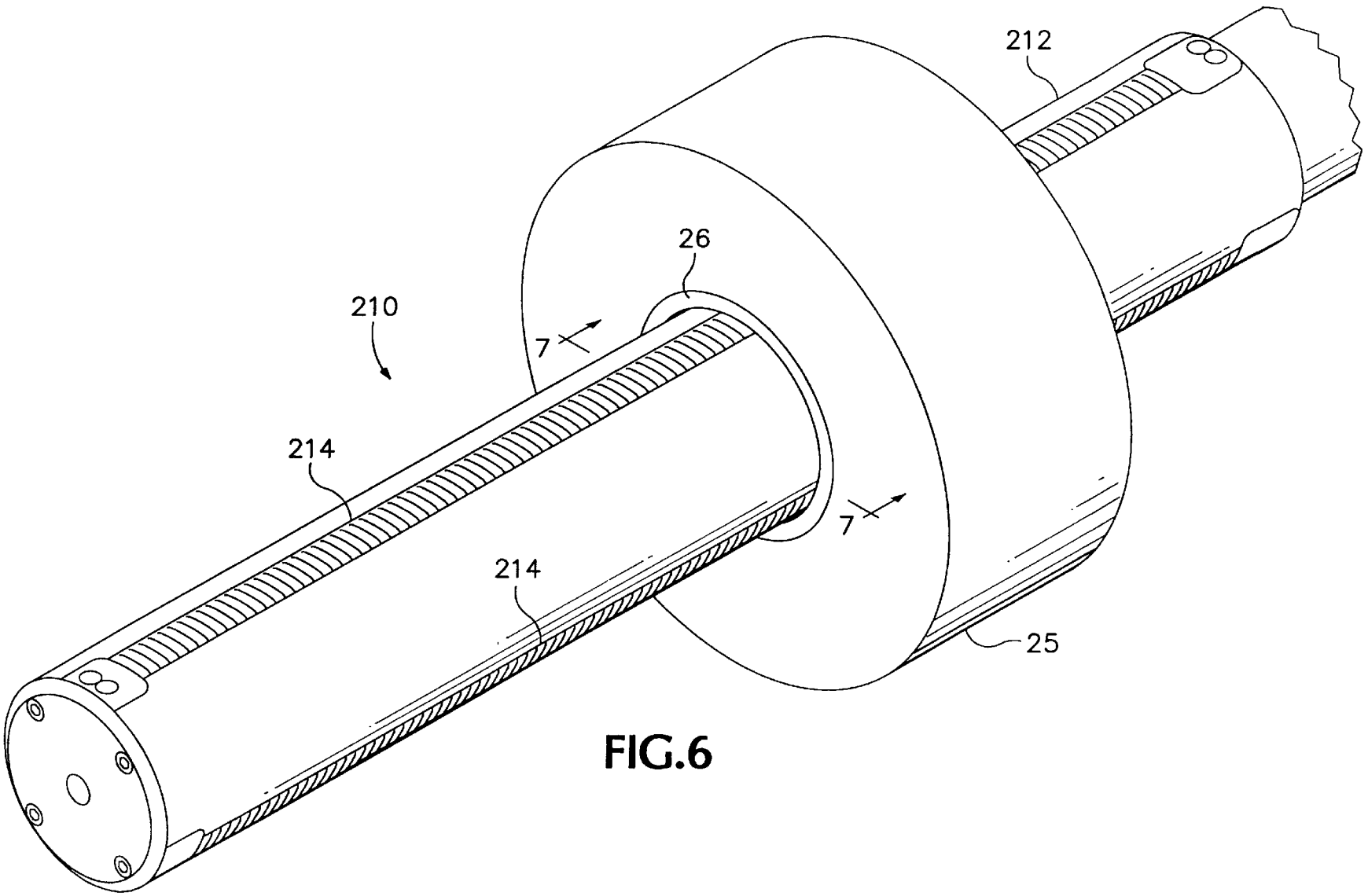
FIG. 6 is a perspective view of an alternative preferred embodiment of a slip shaft assembly according to the present invention.

Referring to FIG. 5, each pressure lug 20 includes a set of shoulders 22 for fitting into a pair of side channels 24 and ensuring the positive retention of lug 20. Referring to FIGS. 3 and 5, each lug 20 also includes a protuberance 30 and a cavity 32, so that when the lugs 20 are aligned in a channel 16, the protuberance 30 of a first lug 20*a* fits into the cavity 32 of a second lug 20*b* and the cavity of lug 20*a* accommodates the protuberance of a third lug 20*c*. The protuberance 30, cavity 32 mating aligns lugs 20 in the radial dimension. The fact that protuberances 30, protrude slightly farther than cavities 32 are indented permits some rotational motion between lugs 20, so that different portions of the chain of lugs 20 may have different radial positions. But the vertical linkage prevents first lug 20*a* from "riding up" on or "catching" on second lug 20*b* or third lug 20*c* and therefore failing to completely retract when bladder 18 is deflated. This failure to retract has been troublesome in prior art systems, particularly when automated machinery has attempted to remove a web spool core, only to have the core interior edge catch on a protruding lug, damaging the core and, sometimes, the automated machinery as well.

Referring particularly to FIG. 4, core stop channels 14*a* and 14*b* accommodate a long bracket 40 that defines a bracket channel 41, which accommodates a core stop retention expansible bladder 42 and a set of core stops 50. Interposed between bladder 42 and core stops 50 is a core stop retention strip 52, having a roughened surface on its radially outward side, for retaining the core stops 50 in fixed axial position. The core stops each include a radially outward portion 53, having a thumbnail slot 54 to facilitate the axial movement of the core stop 50. Additionally, core stops 50 each include a pair of self-retention shoulders 56 that fit into a pair of side channels 58 of bracket channel 41 and a pair of core pressure shoulders 59 (FIG. 1) for steadying the core that is being motion restricted by core stop 50. When shaft 12 is rotated very rapidly, cores tend to warp unless there are outwardly pressing elements spaced at least every 120° along the core interior surface. Without shoulders 59 the outwardly pressing lugs (only lugs 20, in that case) would be spaced 180° degrees apart on shaft assembly 10, permitting warping.

Figure 2:
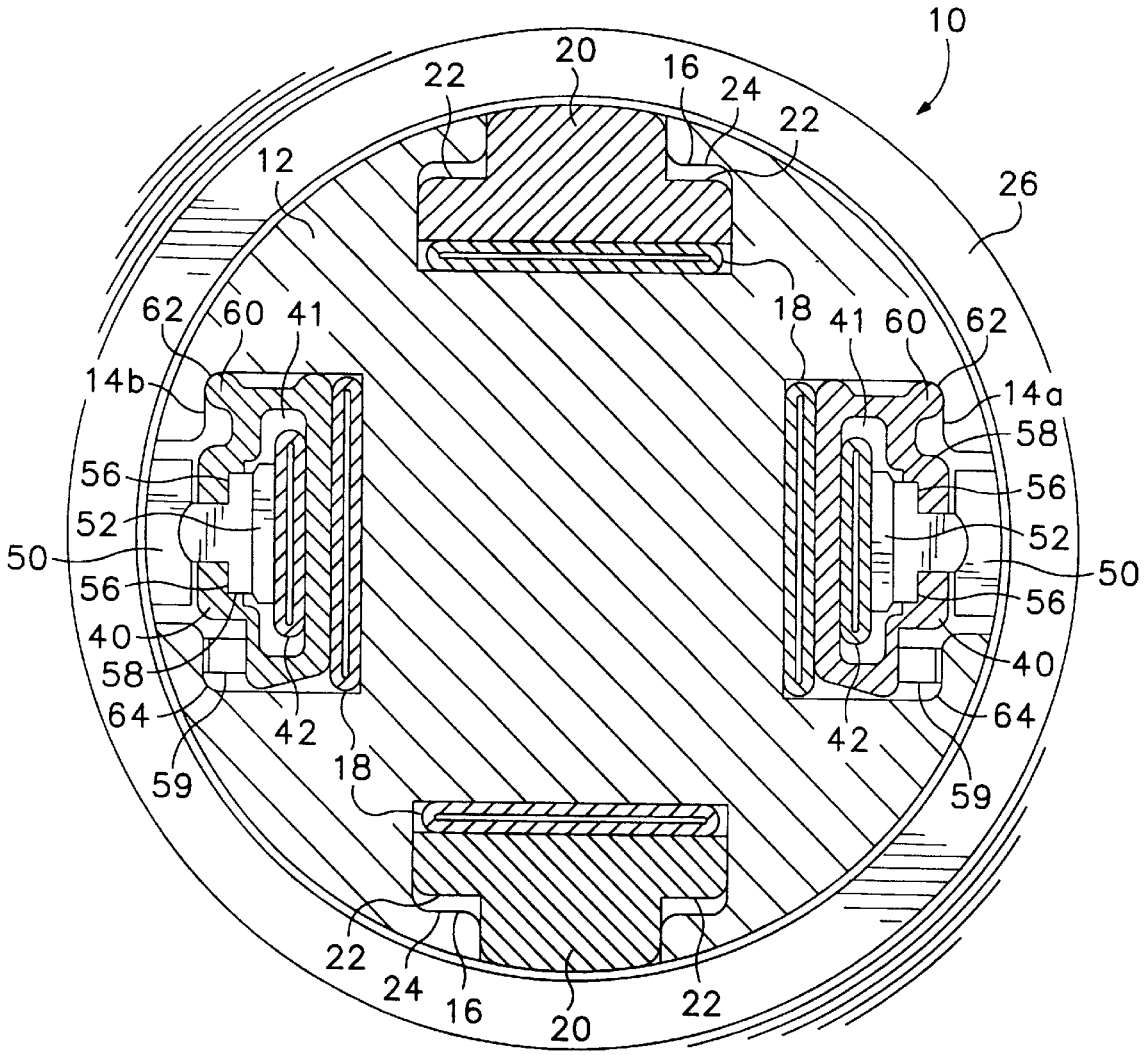
FIG. 2 is a cross-sectional view of the slip shaft assembly of FIG. 1 taken along line 2—2 of FIG. 1.
Figure 2A:
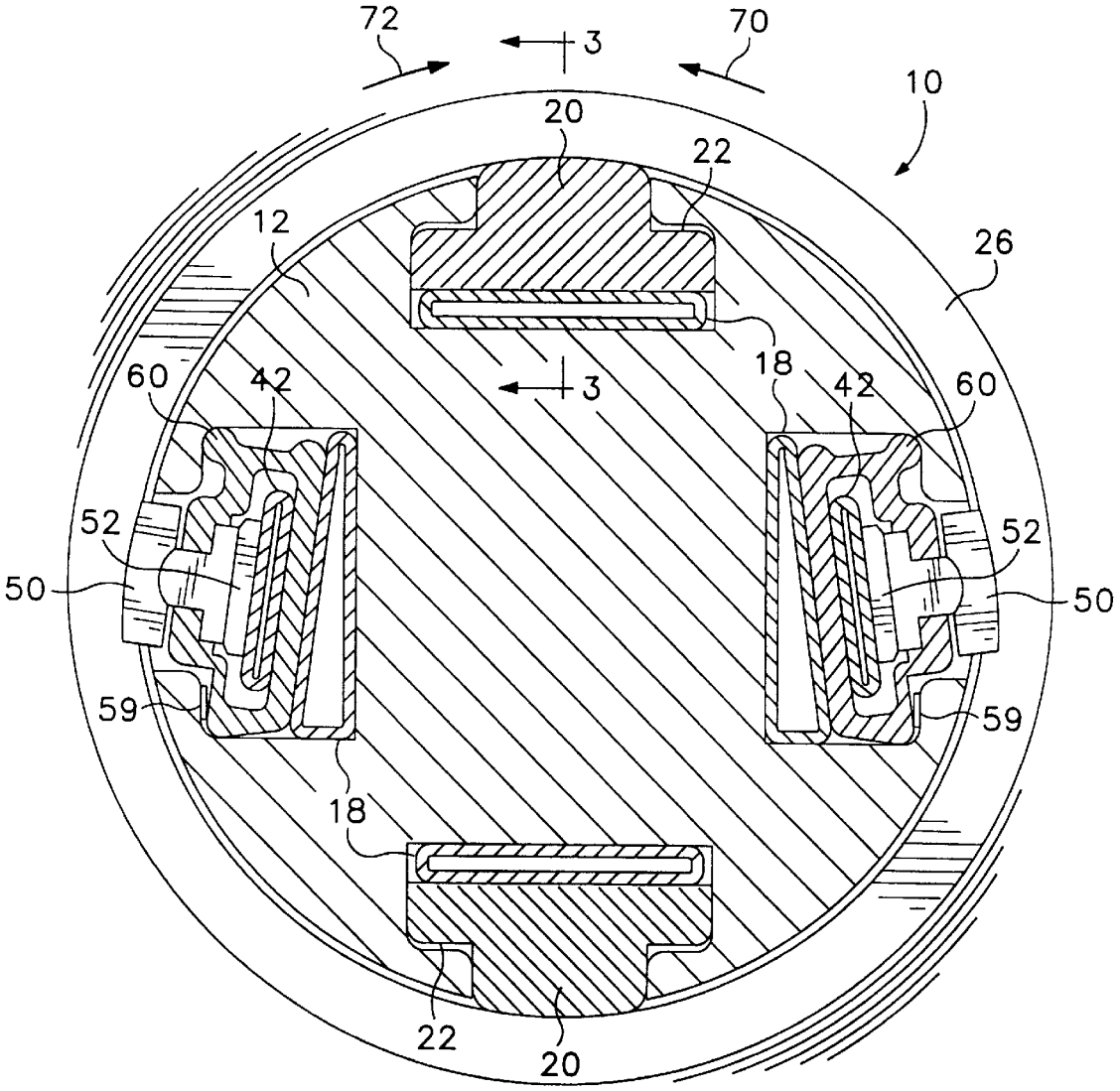
FIG. 2A is a cross-sectional view of the shaft assembly of FIG. 1 taken along line 2—2 of FIG. 1, but showing the core retention bladders in their expanded state.

Referring particularly to FIG. 2A, each bracket 40 includes a lengthwise rim 60 that fits a channel top corner 62 of a core stop channel side channel 64, effectively hinging bracket 40 about corner 62. When bladder 18 is inflated bracket 40 is rotated radially outwardly about corner 62. If a core is slipping in a first rotational direction 70 relative to shaft 12, the core stops 50 in channel 14*a* will be pushed in a further radially outwardly direction by contact with this core. If a core slipping in a second rotational direction 72 relative to shaft 12, the core stop 50 in channel 14*b* will be pushed in a further radially outwardly direction by contact with these cores. Although further outward rotation of core stops 50 is prevented by the contact of a bracket corner 74 with a top corner 62, the outward pushing prevents the core from "riding up" onto and pressing downwardly upon core stop 50, as has been a problem in prior art systems. Significantly, whichever direction the core is slipping relative to shaft 12, one set of core stops 50 will be resistant to the tendency of the core to ride up and over core stops.

During shaft 12 rotation core stop bladder 42 remains inflated keeping core stops 50 in rigidly fixed axial positions to prevent core stop 50 axial migration. When shaft 12 is stopped, bladder 18 is typically deflated and a leaf spring 59 pushes bracket 40 back into a retracted position. This permits the removal of a set of web spools and the placement of a set of web spool cores onto shaft 12. During this operation, bladder 42 may be kept inflated, to retain the positions of core stops 50. This would be the procedure when the new web spools are to be placed in the same positions as the old web spools. If, however, a different arrangement of web spools is desired, bladder 42 may be deflated to permit rearrangement of core stops 50. The ease with which core stops 50 may be fixed and subsequently released is an advantage of the present invention. It is undesirable for personnel to be forced to perform an operation at the core shaft itself to release each core stop individually. Core shafts tend to be placed in somewhat difficult and awkward to access locations.

Referring to FIGS. 6–9, another preferred embodiment of the present invention is a slip shaft assembly 210, including a shaft 212 that defines three channels 213, 214 and 215. (in the figures of the different embodiments, identical elements are marked with the same reference number, e.g. core 26.) Each channel is fitted with a pneumatic (and therefore expansible) bladder 216 that may be controllingly inflated (expanded). Also, in each channel are a set of first lugs 220, interspersed with a set of second lugs 222 so that every two first lugs 220 are separated by a second lug 222. First lugs 220 and second lugs 222 are structurally identical, each having a pair of arms 224 for fitting into a pair of side channels 213*a*, 214*a* and 215*a* to channel 213, 214 and 215, respectively, for the positive retention of lugs 220 and 222. A pair of elastomeric tubes 240 in each of side channels 213*a*, 214*a* and 215*a* push lugs 220 and 222 radially inwardly when bladder 216 is deflated, thereby facilitating the removal of web spool cores, by preventing any lug 220 or 222 from protruding and acting as an obstacle.

Figure 7:
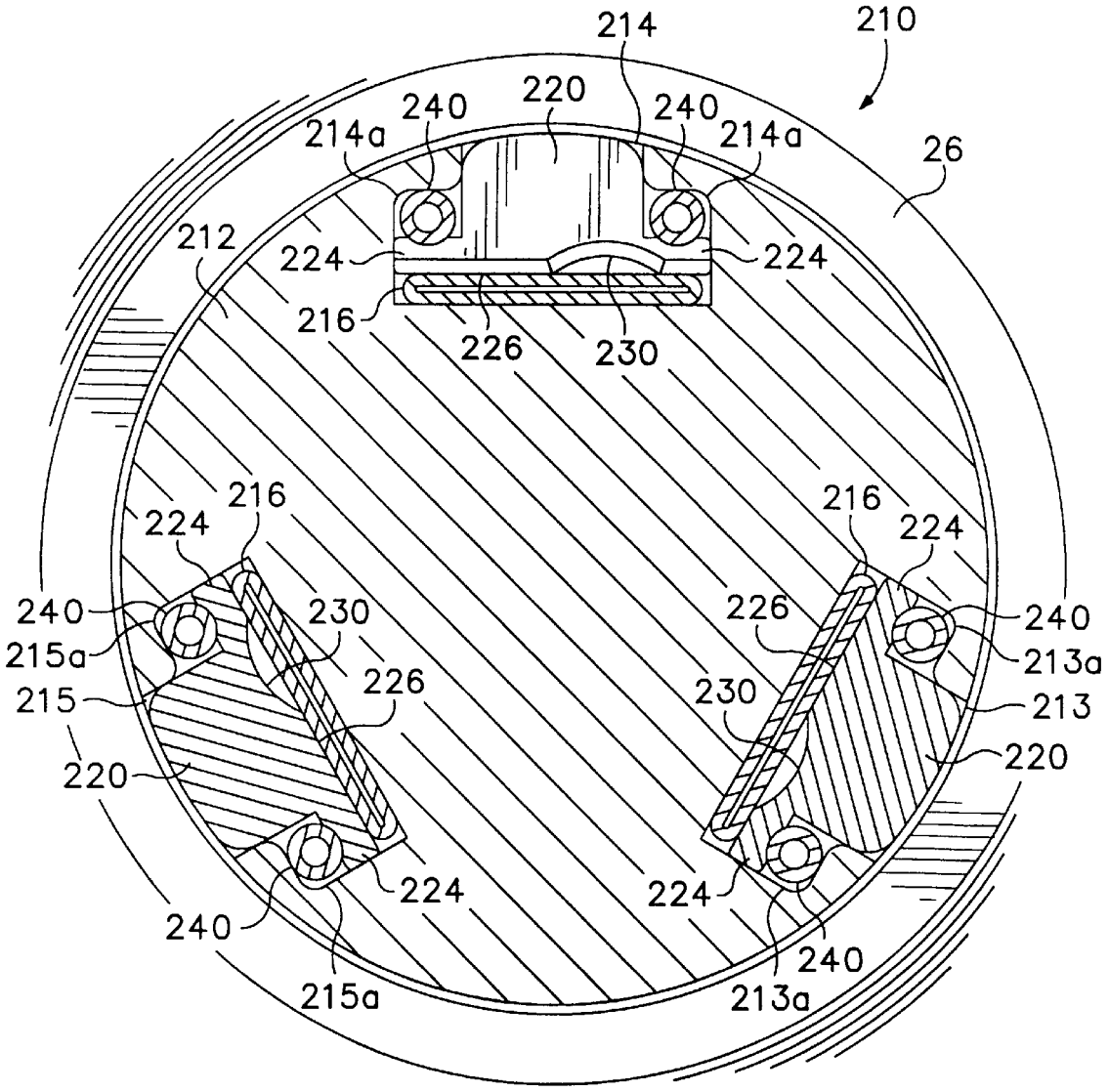
FIG. 7 is a cross-sectional view of the slip shaft assembly of FIG. 6 taken along line 7—7 of FIG. 6.

In addition, each lug 220 and 222 includes a bladder contacting surface 226 that is visible in FIG. 7 because surface 226 is chamfered, exposing itself to the side view shown. Surface 226 includes an indentation 230 that is not centered, so that lugs 220 and 222 are asymmetric. Each first lug 220 is oriented in a first orientation that is 180° from the orientation of lugs 222 (a second orientation), so that the indentation 230 of each first lug is displaced circumferentially from the position of indentation 230 of each second lug 222. In an alternative preferred embodiment (not shown) the indentations of lugs 222 are different in shape from the indentations of lugs 220. For example, lugs 220 could each have a center indentation whereas lugs 222 could have a pair of indentations placed on either side of the bladder contacting surface 226.

Figure 9:
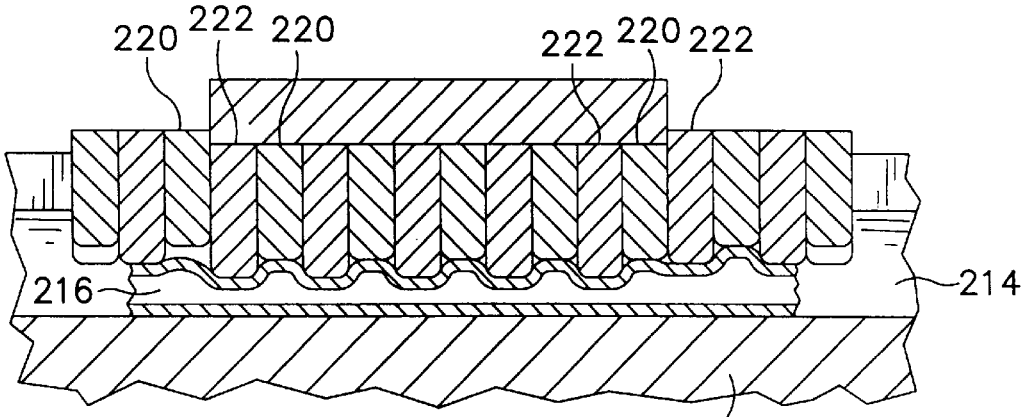
FIG. 9 is a cross-sectional view of a portion of the slip shaft assembly of FIG. 6 taken along line 9—9 of FIG. 8 and showing the pneumatic bladder in its expanded state.
Figure 10:
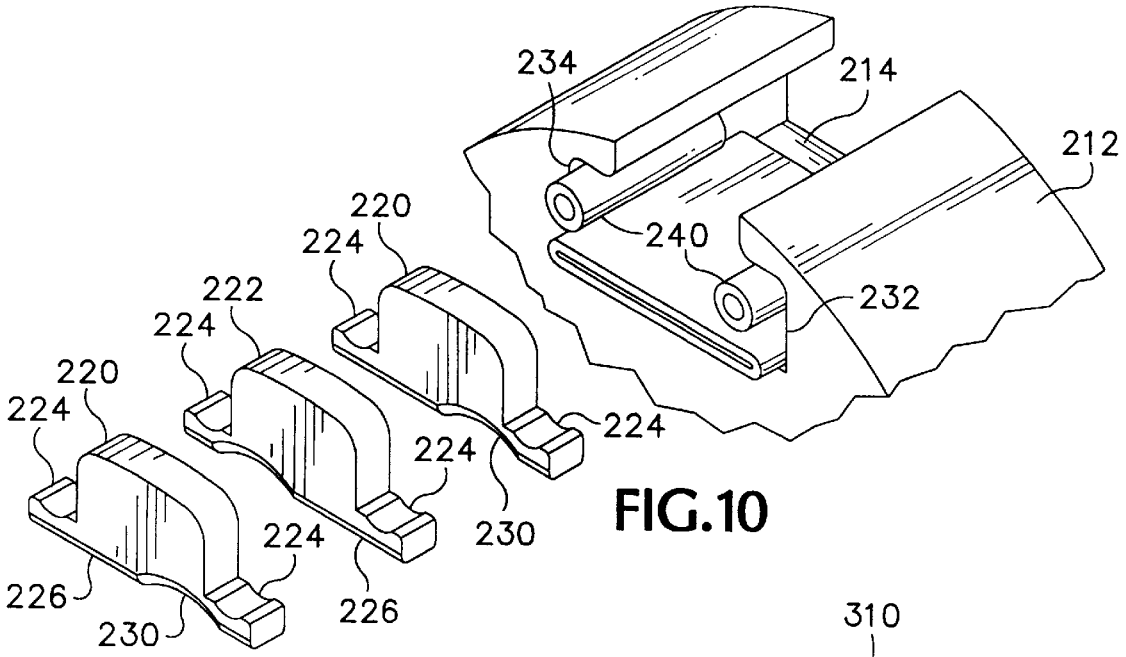
FIG. 10 is a partial expanded view of the slip shaft assembly of FIG. 6 showing the contents of a channel.

The effect of the toggled positioning of indentations 230 is to lessen the dependence of the position of a first lug on the position of a second, neighboring lug. If a first lug is pushed downwardly by a web roll core it will in turn push downwardly on the bladder 216. This, in turn, limits the bladders upward pushing action on neighboring lugs. If this problem is not addressed it detracts from the ability of the lugs 220 and 222 to stop the axial migration of web spool cores, because the lugs which are pushed upwardly at the edges of the web spool cores are not pushed up as high as they otherwise would be. FIGS. 9 and 10, however, show how the toggled positioning of indentations 230 helps to defeat this problem. Lug 222*a* is pushed up quite high because the indentation of lug 220*a* prevents bladder 216 from being fully downwardly constrained on the cross-sectional plane of FIG. 9.

The lugs 220 and 222 in channel 213 are offset by one third of a lug width from the lugs 220 and 222 in channels 214 and 215. In addition the lugs 220 and 222 in channel 214 are offset from the lugs in channel 215 by a third of a lug width. In this manner, the effective granularity of lug spacing is reduced to one third of a lug width. Lugs 220 and 222 act to inhibit the rotation of web spool cores, by pressing on the interior of the cores, while still allowing some slippage so that different web spool cores on shaft 212 may rotate at different speeds. This embodiment has the advantage that it is fully automatic, with no adjustments being necessary for different arrangements of web spool cores.

Figure 12:
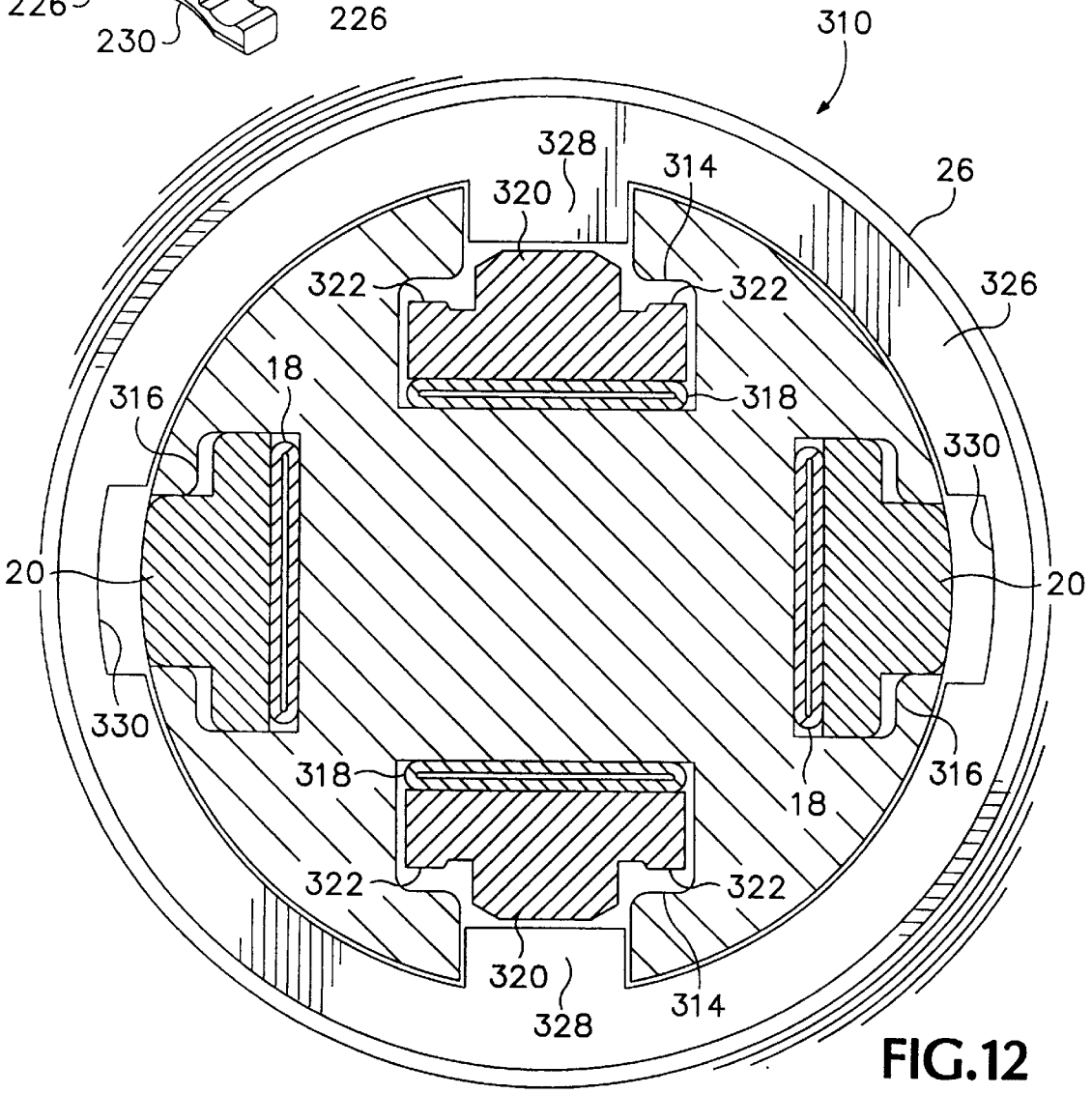
FIG. 12 is a cross-sectional view of the slip shaft assembly of FIG. 11 taken along line 12—12 of FIG. 11.
Figure 11:
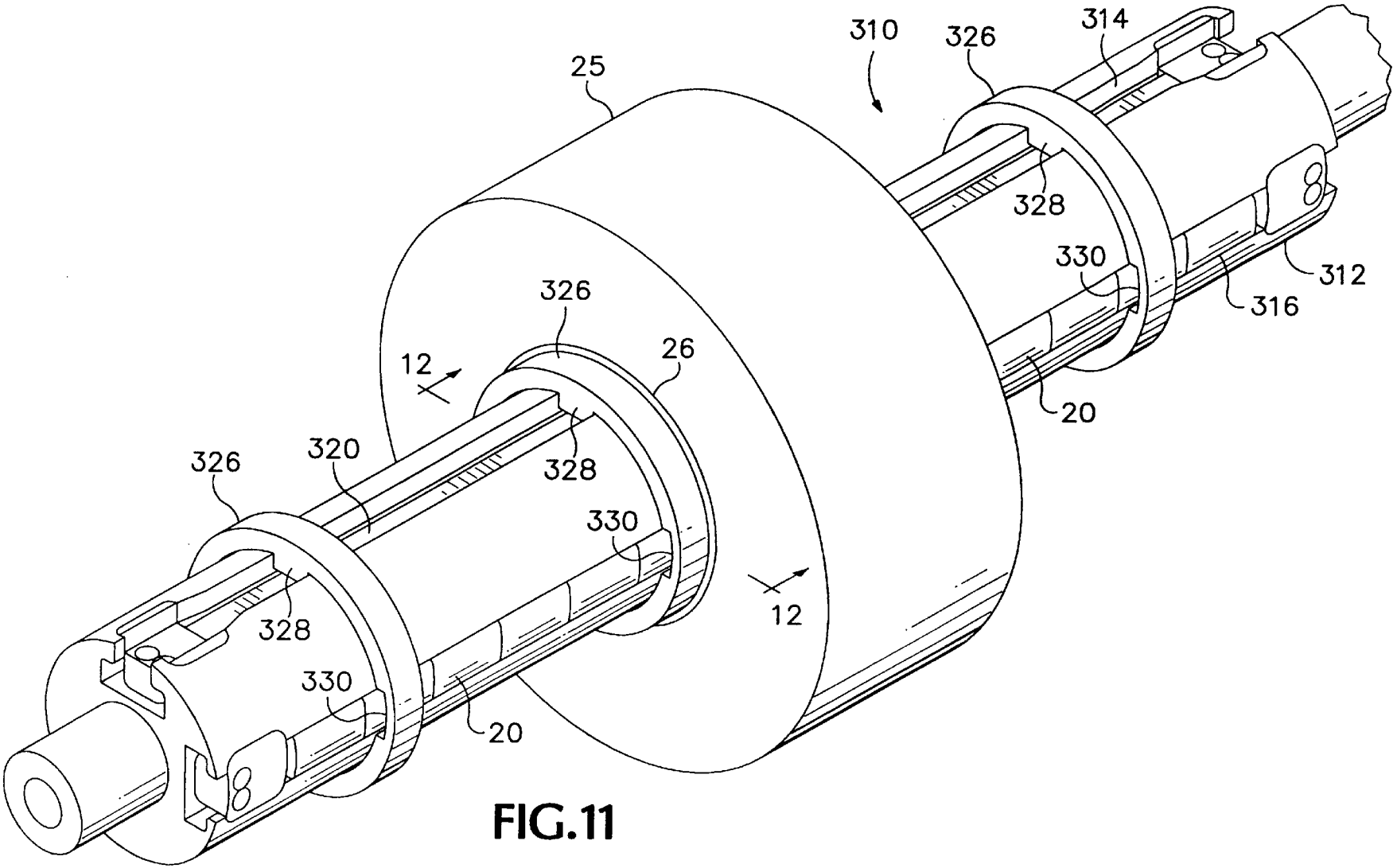
FIG. 11 is a perspective view of an additional alternative preferred embodiment of a slip shaft assembly according to the present invention.

Referring to FIGS. 11 and 12, yet another preferred embodiment of the present invention is a core shaft assembly 310 including a shaft 312 defining a pair of ring retention channels 314 and a pair of core pressure channels 316. Core retention channels 16 are configured in the same manner as channels 16 of assembly 10. Ring retention channels 314 each accommodate a ring retention expansible bladder 318 and a ring retention bar 320 that extend substantially over the operative length of shaft 312 and have a pair of shoulders 322 for positive retention in a pair of side channels 324. A set of rings 326, each having a pair of projections 328, are used to retain the cores in axial position. When bladders 318 are inflated rings 326 are retained in position by the pressure of bars 320 against projections 328. Rings 326 each also includes a pair of notches 330 in their interiors to accommodate lugs 20 when they are pushed outwardly by bladder 18. Although rings 326 must be placed in position each time a new set of web spool cores are placed on shaft 312, it is quite easy to do so by simply sliding each ring 326 onto shaft 312, and into contact with a web spool core.

Figure 13:
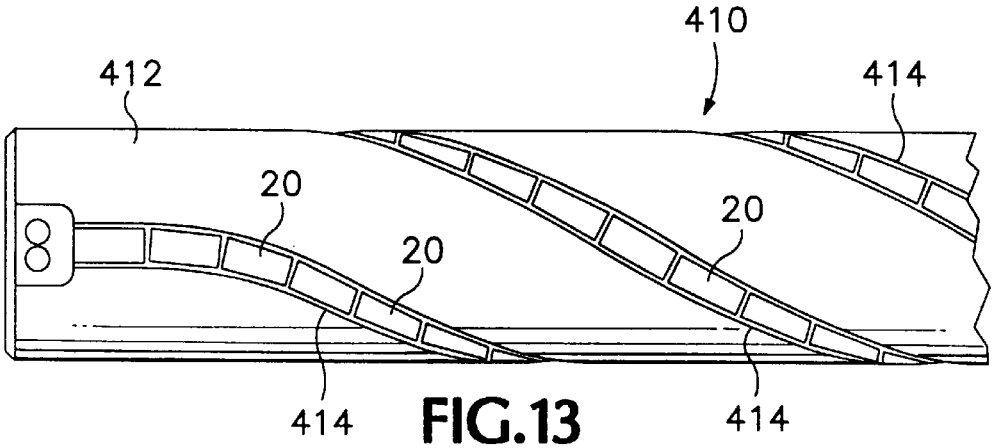
FIG. 13 is a perspective view of a further additional embodiment of a slip shaft assembly according to the present invention.
Figure 8:
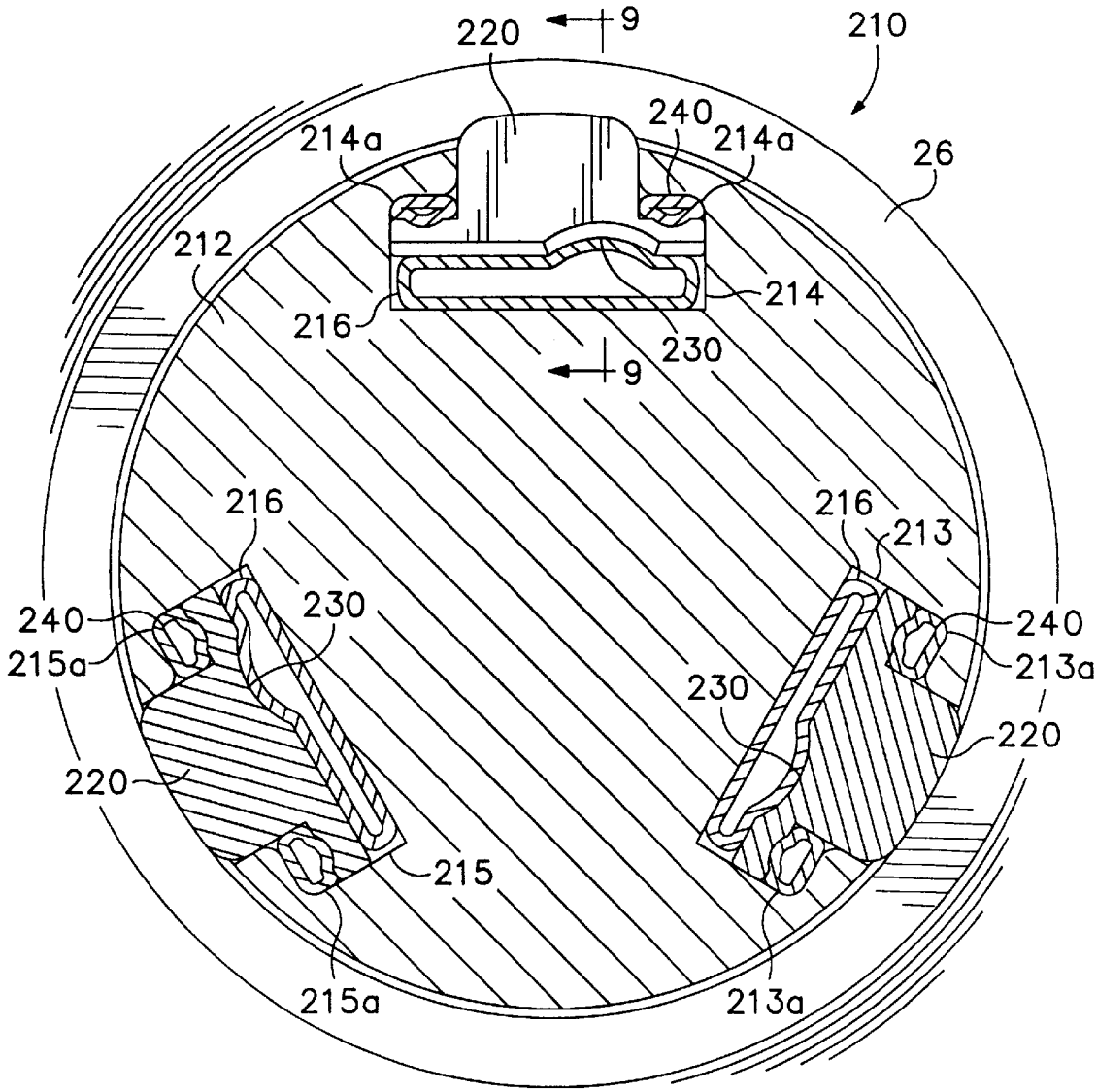
FIG. 8 is a cross-sectional view of the slip shaft assembly of FIG. 6 taken along line 7—7 of FIG. 6 and showing the pneumatic bladders in their expanded state.

Referring to FIG. 13, a grip shaft assembly 410 having a shaft 412 defining helical channels 414 (such as is described in U.S. Pat. No. 5,445,342, incorporated by reference above) for the accommodation of pressure lugs for retaining web spool cores is shown retaining pressure lugs 20, which are shown in greater detail in FIGS. 3 and 5. Because of the shape of metal lugs 20, which have shoulders 22 (for positive retention in a channel) and protuberances 30 and indentations 32 (for mutual radial linkage) lugs 20 may be set into helical channels 414 with enough leeway to compensate for the lack of flexibility of lugs 20 themselves.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A core shaft assembly adapted to retain a set of web spool cores in axially fixed positions, comprising:

(a) a shaft defining a first channel;

(b) a first controllably expansible bladder set into said first channel;

(c) a bracket set into said first channel radially outwardly of said first pneumatic bladder and defining a second channel;

(d) a second controllably expansible bladder set into said second channel and being independently controllably expansible from said first controllably expansible bladder; and (e) a set of core stops set into said second channel radially outwardly of said second controllably expansible bladder.

2. The core shaft assembly of claim 1 wherein said first channel defines a first longitudinal side and said bracket includes a first hinge for associating the bracket with said first longitudinal side of said channel so that when said bladder is expanded said bracket and said core stops rotate about said first hinge as it is pushed radially outwardly by said first controllably expansible bladder in a first rotational direction about said first hinge.

3. The core shaft assembly of claim 2 wherein said core shaft further defines a third channel and said third channel includes a second longitudinal side and a third longitudinal side that is circumferentially closer to said first longitudinal side than is said second longitudinal side and wherein said shaft assembly includes a second bracket fitted with second bracket core stops, said second bracket including a second hinge for associating the bracket with said third longitudinal side of said second channel so that when said bladder is inflated said bracket and said second bracket core stops rotate about said second hinge as it is pushed radially outwardly by said bladder in a second rotational direction opposed to said first rotational direction.

4. A core shaft assembly adapted to retain a set of web spool cores in axially fixed positions, comprising:

(a) a shaft defining a channel having a first longitudinal side and a second longitudinal side;

(b) a bladder set into said channel;

(c) a core stop set into said channel over said bladder and a hinge for associating the core stop with said first longitudinal side of said channel so that when said bladder is inflated said core stop rotates about said hinge as it is pushed radially outwardly by said bladder in a first rotational direction.

5. The core shaft assembly of claim 4 wherein said channel is a first channel and said core shaft further defines a second channel and said second channel includes a second longitudinal side and a third longitudinal side that is circumferentially closer to said first longitudinal side than is said second longitudinal side and wherein said shaft assembly includes a second core stop that is set into said second channel, and a hinge for associating the second core stop with said third longitudinal side of said second channel so that when said bladder is inflated said second core stop rotates about said hinge as it is pushed radially outwardly by said bladder in a second rotational direction opposed to said first rotational direction.

6. An expansible core shaft assembly adapted to retain a set of web spool cores in axially fixed positions while permitting rotational slippage of said web spool cores, said assembly comprising:

(a) a shaft defining a channel extending substantially axially along said shaft;

(b) an expansible bladder retained in said channel; and (c) a set of first lugs and a set of second lugs retained in said channel radially outwardly of said expansible bladder and mutually interspersed, each said first lug having a bladder facing surface defining a first indentation and each said second lug having a bladder facing surface defining a second indentation and wherein said first indentations and said second indentations are misaligned from each other relative to a longitudinal axis of the core shaft.

7. The expansible core shaft assembly of claim 6, wherein said first lugs and second lugs are identical but are oriented differently within said channel so that said first indentations and said second indentations are mutually distinguished in position.

8. The core shaft assembly of claim 6 wherein said shaft further defines a second channel substantially axially along said core shaft and further including:

(a) a second expansible bladder retained in said second channel;

(b) a set of third lugs and a set of fourth lugs retained in said channel radially outwardly of said expansible bladder and mutually interspersed, each said third lug having a bladder facing surface defining a third indentation and each said fourth lug having a bladder facing surface defining a fourth indentation and wherein said third indentations and said fourth indentations are misaligned from each other relative to a longitudinal axis of the core shaft.

9. The core shaft assembly of claim 8 in which said first, second, third, and fourth lugs have a uniform width in the shaft assembly axial dimension and said third lugs and said fourth lugs are offset in axial position from said first and second lugs by a fraction of said uniform width.

10. A core shaft assembly adapted to retain a set of web spool cores in axially fixed positions, comprising:

(a) a shaft defining a channel;

(b) a fluid expansible bladder set into said channel;

(c) a set of rings, positioned about said shaft and each having an inward projection fitted into said channel, and a bar engaging said inward projection when said expansible bladder is in its expanded state to retain each said ring in axial position.

11. The core shaft assembly of claim 10 in which said shaft assembly includes a further channel that accommodates a second fluid expansible bladder and pressure lugs set radially outwardly of said fluid expansible bladder so that when said second fluid expansible bladder is expanded said pressure lugs are pushed outwardly and wherein each said ring further includes an indentation on its radially inward side adapted to accommodate said pressure lugs when said bladder is inflated.

12. A core shaft assembly adapted to retain a web roll core, comprising:

(a) a shaft defining a channel;

(b) a fluid expansible bladder set into said channel;

(c) a set of lugs positioned in said channel radially over said fluid expansible bladder, each said lug having a first lug contacting side and a second lug contacting side and wherein said first lug contacting side of a first lug includes a first mating formation which mates with a second mating formation on said second lug contacting side of an adjacent lug in such a manner that said first side of said first lug and said second side of said adjacent lug are linked in radial position.

13. The core shaft assembly of claim 12 wherein said first mating formation comprises an indentation and said second mating formation comprises a protuberance positioned, shaped and sized to mate with said indentation.

14. The core shaft assembly of claim 12 wherein said protuberance protrudes farther than the depth of said indentation.

15. The core shaft assembly of claim 12 in which said channel is helical.

* * * * *